US011799222B2

(12) United States Patent
Wada et al.

(10) Patent No.: US 11,799,222 B2
(45) Date of Patent: Oct. 24, 2023

(54) CONNECTOR HAVING A FITTING, A HOUSING, AND A CONDUCTIVE COMPONENT

(71) Applicant: Yazaki Corporation, Tokyo (JP)

(72) Inventors: Kotaro Wada, Shizuoka (JP); Naoki Takamura, Shizuoka (JP); Kaoru Sawairi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 154 days.

(21) Appl. No.: 17/455,340

(22) Filed: Nov. 17, 2021

(65) Prior Publication Data

US 2022/0190500 A1 Jun. 16, 2022

(30) Foreign Application Priority Data

Dec. 11, 2020 (JP) ..... 2020-205434

(51) Int. Cl.

| | |
|---|---|
| ***H01R 13/627*** | (2006.01) |
| ***H01R 12/71*** | (2011.01) |
| ***H01R 12/58*** | (2011.01) |
| ***H01R 13/428*** | (2006.01) |

(Continued)

(52) U.S. Cl.

CPC ..... *H01R 12/716* (2013.01); *H01R 12/58* (2013.01); *H01R 13/428* (2013.01); *H01R 13/633* (2013.01); *H01R 13/639* (2013.01)

(58) Field of Classification Search

CPC .... H01R 12/716; H01R 12/58; H01R 13/428; H01R 13/633; H01R 13/639; H01R 13/432; H01R 12/592; H01R 43/16; H01R 43/20; H01R 13/631

See application file for complete search history.

(56) References Cited

U.S. PATENT DOCUMENTS

| | | | | |
|---|---|---|---|---|
| 6,099,361 | A | 8/2000 | Takanashi | |
| 10,826,241 | B2 * | 11/2020 | Ito | H01R 13/639 |
| 10,965,051 | B2 * | 3/2021 | Ito | H01R 13/41 |

(Continued)

FOREIGN PATENT DOCUMENTS

| | | | |
|---|---|---|---|
| EP | 0877446 | A2 | 11/1998 |
| JP | 10-144416 | A | 5/1998 |

(Continued)

*Primary Examiner* — Abdullah A Riyami
*Assistant Examiner* — Nelson R. Burgos-Guntin
(74) *Attorney, Agent, or Firm* — Sughrue Mion, PLLC

(57) ABSTRACT

There is provided a connector including: a terminal fitting including a terminal portion, a conductor connection portion, and a connecting portion that connects the terminal portion and the conductor connection portion; a housing including an accommodating chamber that accommodates the terminal fitting from the terminal portion to the connecting portion, and a terminal drawing port that allows the conductor connection portion to be drawn out of the accommodating chamber toward a removal direction of the terminal portion; and a conductive component soldering a conductor to the conductor connection portion inserted into a through-hole, in which the connecting portion includes a first coupling portion that is coupled to the terminal portion, a second coupling portion that is coupled to the conductor connection portion, and a third coupling portion.

10 Claims, 9 Drawing Sheets

(51) Int. Cl.
*H01R 13/633* (2006.01)
*H01R 13/639* (2006.01)

(56) References Cited

U.S. PATENT DOCUMENTS

| | | | | |
|---|---|---|---|---|
| 2015/0207260 | A1* | 7/2015 | Sugiyama | H01R 13/426 439/752 |
| 2018/0026384 | A1* | 1/2018 | Shibuya | H01R 12/737 439/637 |
| 2018/0287285 | A1* | 10/2018 | Motohashi | H01R 24/60 |
| 2019/0334265 | A1* | 10/2019 | Ito | H01R 13/41 |
| 2019/0334270 | A1* | 10/2019 | Ito | H01R 13/112 |
| 2019/0334286 | A1* | 10/2019 | Ito | H01R 13/42 |
| 2019/0334287 | A1* | 10/2019 | Ito | H01R 12/79 |
| 2020/0169037 | A1* | 5/2020 | Ito | H01R 12/714 |

FOREIGN PATENT DOCUMENTS

| | | | |
|---|---|---|---|
| JP | 2016-103432 | A | 6/2016 |
| JP | 2019-153490 | A | 9/2019 |

* cited by examiner

CONNECTOR HAVING A FITTING, A HOUSING, AND A CONDUCTIVE COMPONENT

CROSS-REFERENCE TO RELATED APPLICATION(S)

The present application claims priority to and incorporates by reference the entire contents of Japanese Patent Application No. 2020-205434 filed in Japan on Dec. 11, 2020.

BACKGROUND OF THE INVENTION

1. Field of the Invention

The present invention relates to a connector.

2. Description of the Related Art

Conventionally, a connector including a terminal fitting, a housing in which the terminal fitting is accommodated, a conductive component (flexible printed circuit board (so-called FPC), a printed circuit board (so-called PCB), and the like) that physically and electrically connects a conductor to the terminal fitting has been known. In the connector, a connector in which a conductor connection portion of the terminal fitting is inserted into a through-hole of the conductive component and the conductor connection portion is soldered to the conductor of the conductive component to connect the conductor physically and electrically to the terminal fitting has been known. This type of connector is disclosed in, for example, Japanese Patent Application Laid-open No. 2019-153490 below.

Meanwhile, in the connector of Japanese Patent Application Laid-open No. 2019-153490, in order to facilitate insertion of the conductor connection portion into the through-hole when the terminal fitting and the conductive component are assembled, the conductor connection portion is formed as a part of the fixing portion of the terminal fitting, and the fixing portion is press-fitted and fixed into an accommodating chamber of the housing, thereby positioning the conductor connection portion with respect to the through-hole. However, in this connector, since the fixing portion is press-fitted into the accommodating chamber without being elastically deformed, an insertion force that needs to be applied to the terminal fitting at the time of press-fitting may increase. Therefore, in this connector, there is room for improvement in facilitating positioning between the conductor connection portion and the through-hole.

SUMMARY OF THE INVENTION

An object of the present invention is to provide a connector that enables simple positioning between a conductor connection portion and a through-hole.

To achieve the above objection, a connector according to one aspect of the invention includes a terminal fitting including a terminal portion that is fitted into and connected to a counterpart terminal portion, a conductor connection portion, and a connecting portion that connects the terminal portion and the conductor connection portion; a housing including an accommodating chamber that accommodates the terminal fitting from the terminal portion to the connecting portion, and a terminal drawing port that allows the conductor connection portion to be drawn out of the accommodating chamber toward a removal direction of the terminal portion with respect to the counterpart terminal portion; and a conductive component formed as a laminate of a conductor and an insulator with a through-hole, and soldering the conductor to the conductor connection portion inserted into the through-hole and physically and electrically connecting the conductor connection portion and the conductor, wherein the connecting portion includes a first coupling portion that is coupled to the terminal portion, a second coupling portion that is coupled to the conductor connection portion, and a third coupling portion that is elastically deformable and connecting the first coupling portion and the second coupling portion, and the connecting portion in the accommodating chamber allows the conductor connection portion to extend in the removal direction in a state in which a first resilient force due to elastic deformation of the third coupling portion is applied from the terminal portion to a first inner wall portion of the accommodating chamber and in a state in which a second resilient force opposite to the first resilient force due to the elastic deformation of the third coupling portion is applied from the second coupling portion to a second inner wall portion of the accommodating chamber.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment of a connector according to the present invention will be described in detail with reference to the drawings. Note that the present invention is not limited by the embodiment.

Embodiment

One embodiment of a connector according to the present invention will be described with reference to FIGS. 1 to 10.

Figure 1:
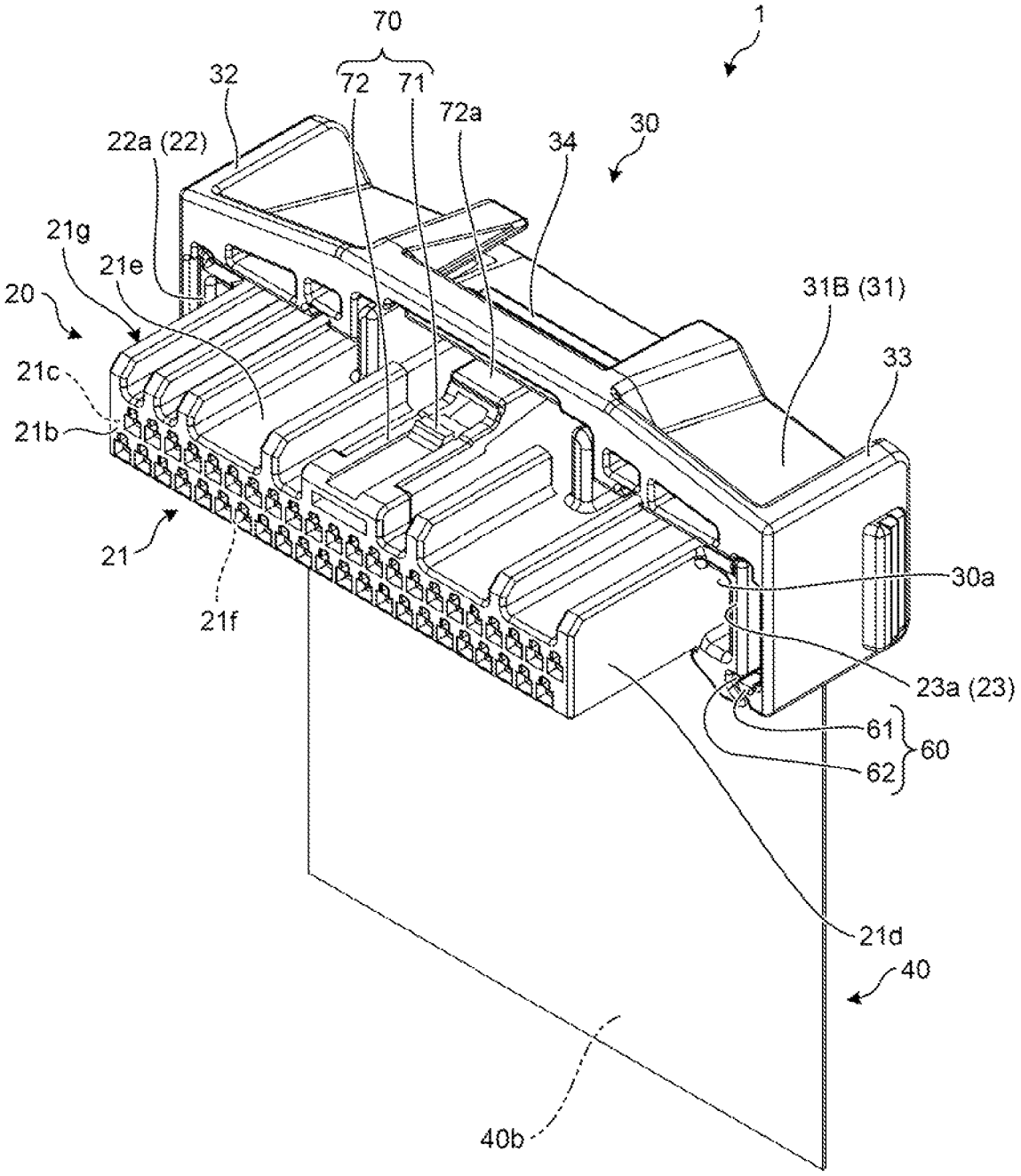
FIG. 1 is a perspective view illustrating a connector according to an embodiment.
Figure 2:
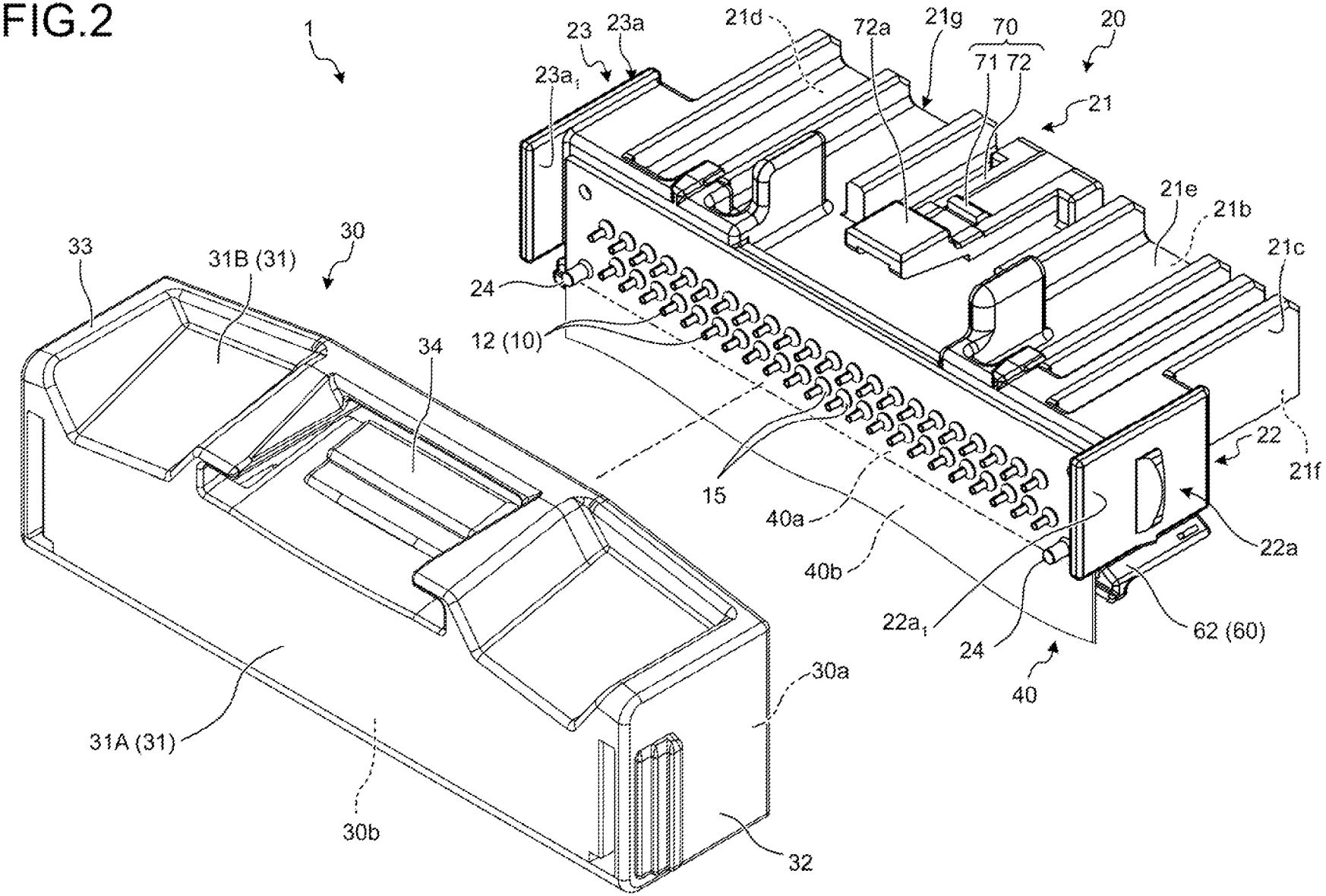
FIG. 2 is an exploded perspective view illustrating the connector before cover connection.
Figure 3:
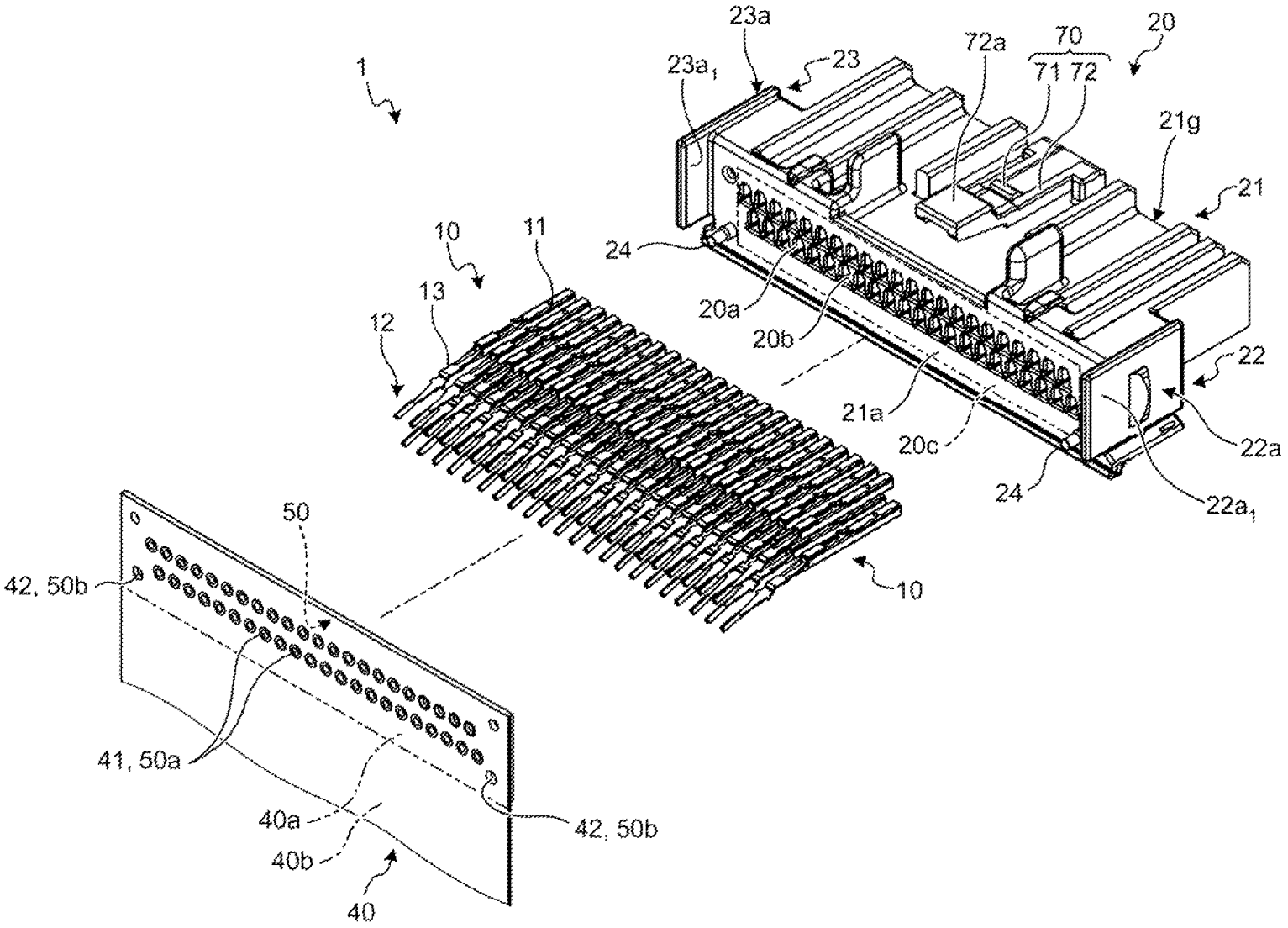
FIG. 3 is an exploded perspective view illustrating the connector (excluding a cover) according to the embodiment.
Figure 4:
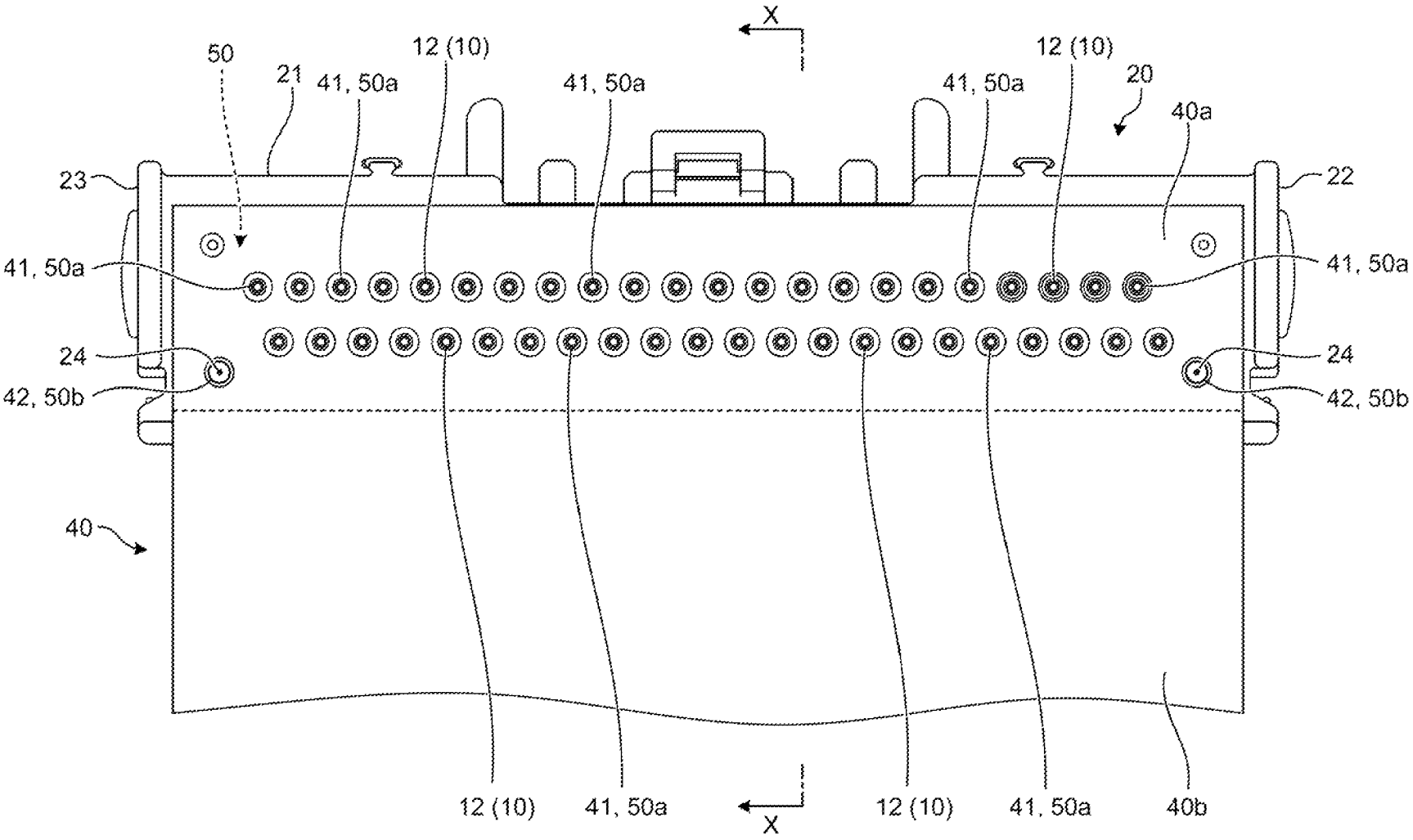
FIG. 4 is a plan view of a terminal fitting and a conductive component assembled to a housing before soldering when viewed from a conductor connection portion side.
Figure 5:
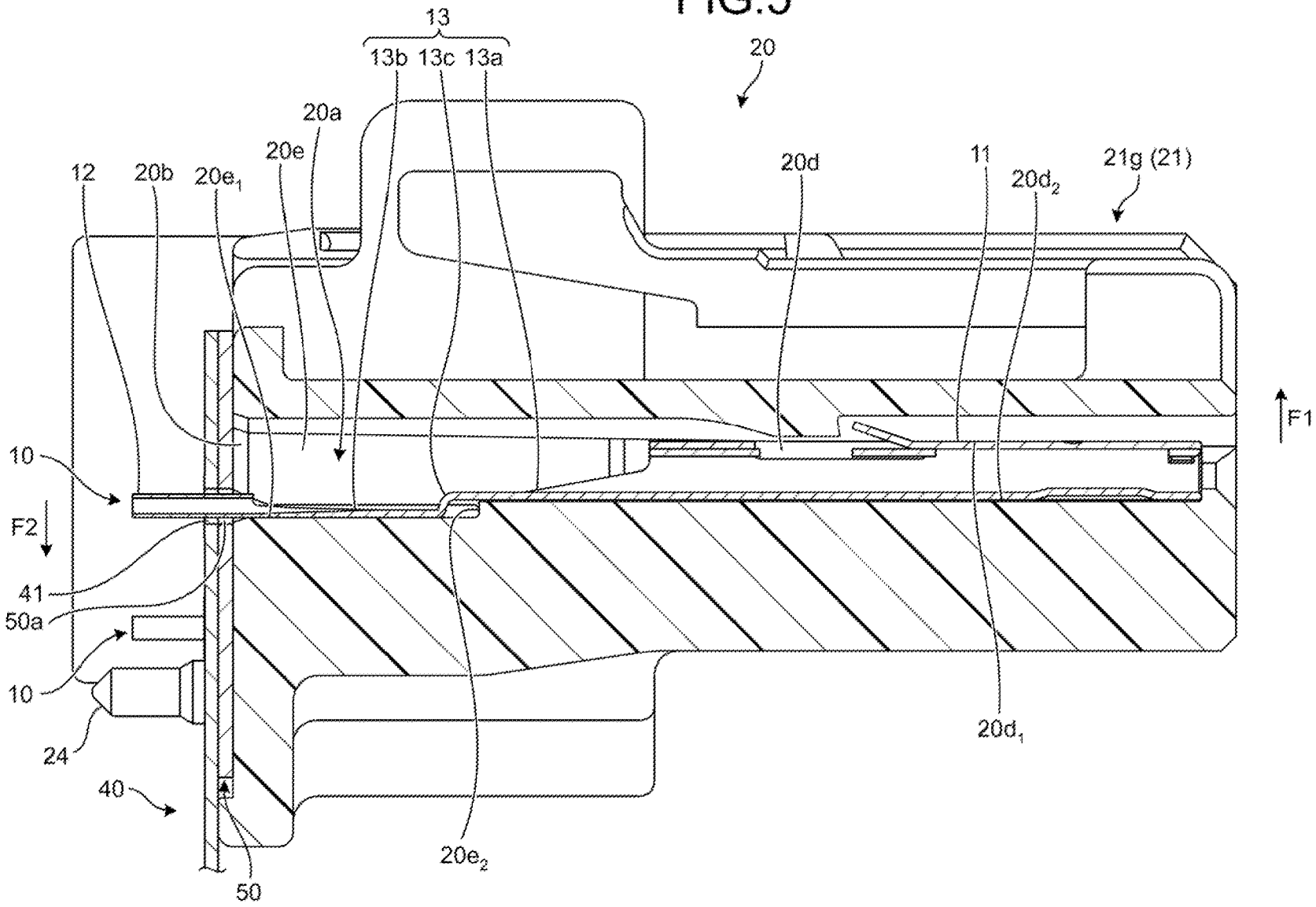
FIG. 5 is a cross-sectional view taken along line X-X of FIG. 4.

Reference numeral 1 in FIGS. 1 to 3 denotes a connector according to the present embodiment. The connector 1 includes a terminal fitting 10, a housing 20 in which the terminal fitting 10 is accommodated, a cover 30 that is assembled to the housing 20, and a conductive component 40 that is physically and electrically connected to the terminal fitting 10 in an inner space formed by the housing 20 and the cover 30 in an assembled state. The conductive component 40 is assembled to the housing 20 and the terminal fitting 10 accommodated in the housing 20 (FIGS. 4 and 5).

The terminal fitting 10 is formed of a conductive material such as metal. For example, the terminal fitting 10 is formed into a predetermined shape by press forming such as bending or cutting a metal plate as a base material. In addition, the terminal fitting 10 includes a terminal portion 11 that physically and electrically connect the terminal fitting 10 to a counterpart terminal fitting (not illustrated) of a counterpart connector, and a conductor connection portion 12 that physically and electrically connect the terminal fitting 10 to the conductive component 40 (FIGS. 3 and 5 to 7). The terminal fitting 10 has a connecting portion 13 that connects the terminal portion 11 and the conductor connection portion 12 (FIGS. 3 and 5 to 7). The counterpart connector may be, for example, a connector that is electrically connected to a counterpart electrical device (an inverter or the like), or may be a connector portion included in a terminal block provided in the counterpart electrical device.

The terminal portion 11 is formed in, for example, a female terminal shape or a male terminal shape. The terminal portion 11 is physically and electrically connected to the counterpart terminal fitting by being fitted into and connected to the counterpart terminal portion of the counterpart terminal fitting. The terminal portion 11 described here is formed in a female terminal shape having a square tubular box body, and is inserted into and removed from the counterpart terminal portion along a tubular axis direction.

Hereinafter, when an insertion direction is simply described without any particular reference, it indicates an insertion direction in which the terminal portion 11 is inserted into the counterpart terminal portion. Further, when a removal direction is simply described without any particular reference, it indicates a removal direction in which the terminal portion 11 is removed from the counterpart terminal portion. Further, when an insertion-and-removal direction is simply described without any particular reference, it indicates an insertion-and-removal direction in which the terminal portion 11 is inserted into and removed from the counterpart terminal portion.

The conductor connection portion 12 is formed in a tubular shape. The conductor connection portion 12 described here is formed in a cylindrical shape.

Figure 6:
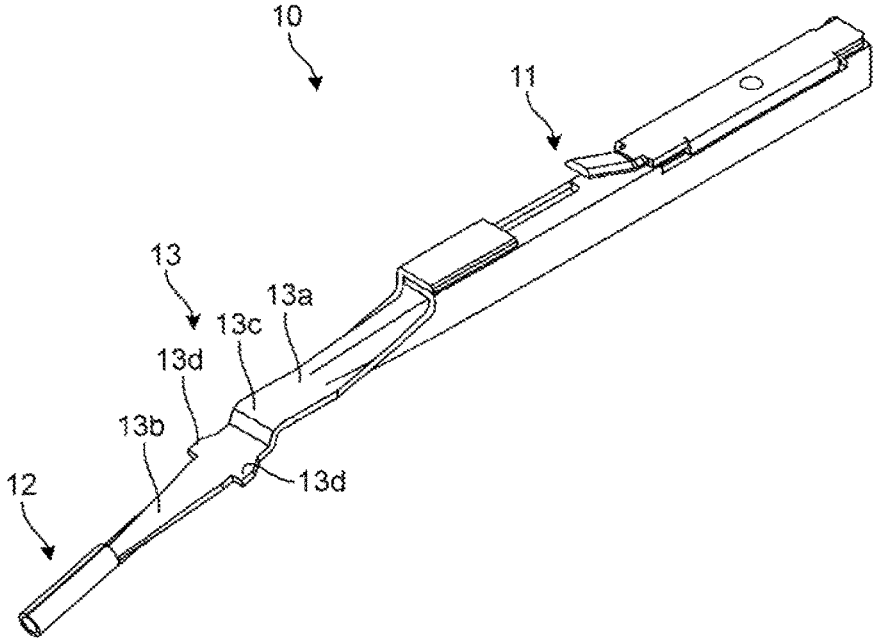
FIG. 6 is a perspective view illustrating the terminal fitting.
Figure 7:
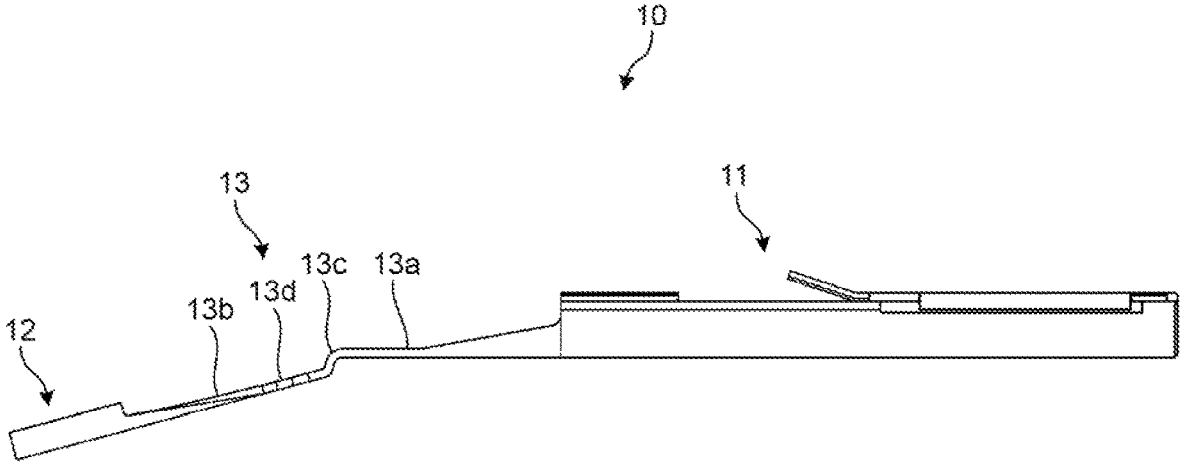
FIG. 7 is a side view illustrating the terminal fitting.

The connecting portion 13 includes a first coupling portion 13*a* that is coupled to the terminal portion 11, a second coupling portion 13*b* that is coupled to the conductor connection portion 12, and a third coupling portion 13*c* that is elastically deformable and connects the first coupling portion 13*a* and the second coupling portion 13*b* (FIGS. 5 to 7).

Figure 8:
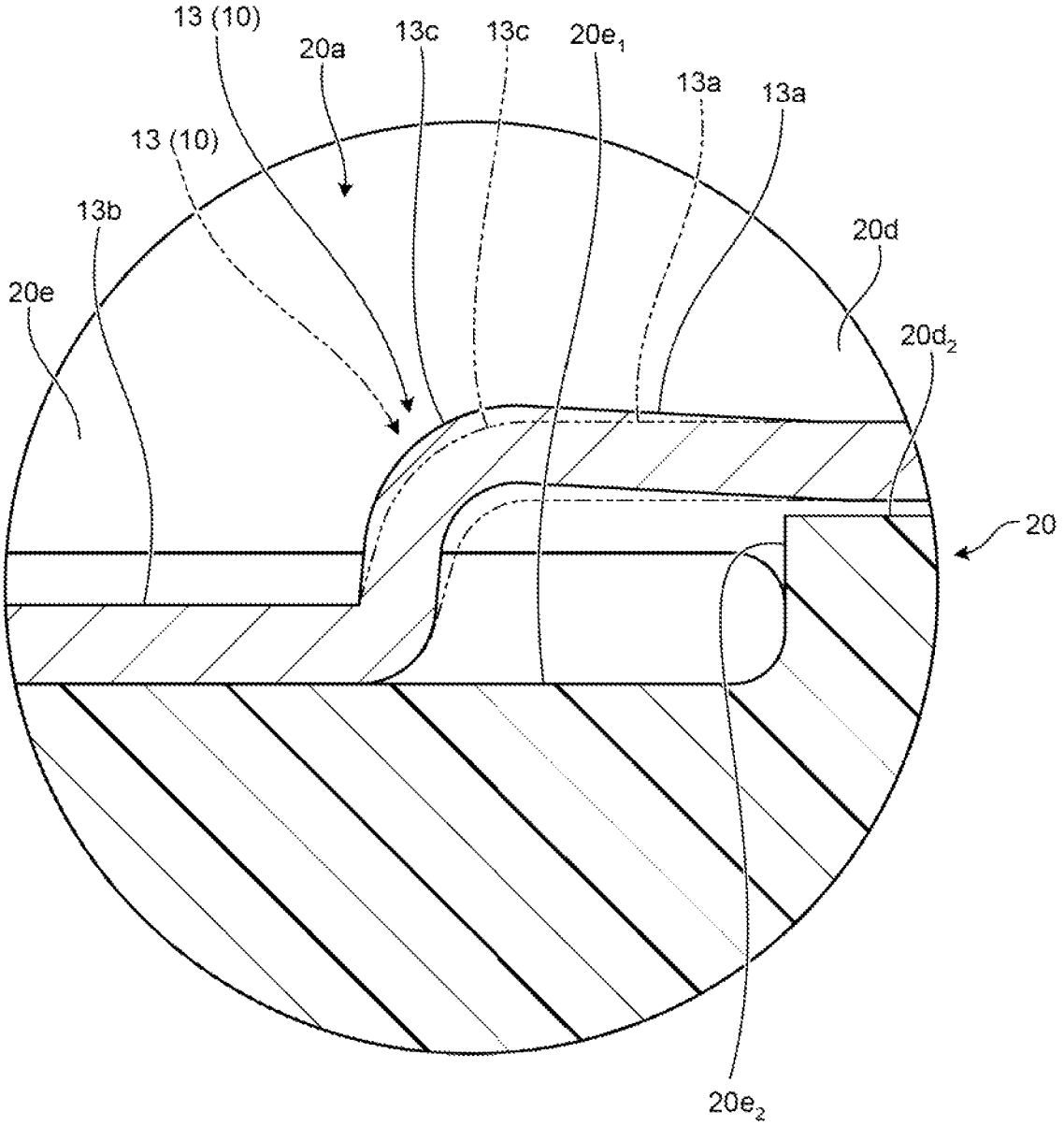
FIG. 8 is an explanatory view schematically illustrating movement of a third coupling portion at the time of connector fitting.

The terminal fitting 10 is formed such that the tubular axis direction of the terminal portion 11 and the tubular axis direction of the conductor connection portion 12 intersect with each other with the third coupling portion 13*c* of the connecting portion 13 as a boundary (FIGS. 6 and 7). The terminal fitting 10 interests the terminal portion 11 and the conductor connection portion 12 such that a tubular axis of the terminal portion 11 and a tubular axis of the conductor connection portion 12 form an obtuse angle. The terminal fitting 10 is formed such that the tubular axis direction of the terminal portion 11 and the tubular axis direction of the conductor connection portion 12 can be directed in the same direction due to the elastic deformation of the third coupling portion 13*c* (FIG. 5). The third coupling portion 13*c* may have any shape as long as it enables such elastic deformation. For example, the third coupling portion 13*c* described here is formed in a crank shape in which the first coupling portion 13*a* and the second coupling portion 13*b* are offset in a direction orthogonal to the removal direction (FIGS. 5 to 7). The crank-shaped third coupling portion 13*c* can also be elastically deformed to bring the terminal portion 11 (first coupling portion 13*a*) and the conductor connection portion 12 (second coupling portion 13*b*) close to or separate from each other (FIG. 8). For example, in the terminal fitting 10, when the tubular axis direction of the terminal portion 11 and the tubular axis direction of the conductor connection portion 12 face the same direction, the third coupling portion 13*c* can be further elastically deformed in the tubular axis direction, and the terminal portion 11 and the conductor connection portion 12 can thus be brought close to or separated from each other in the tubular axis direction due to the elastic deformation. In FIG. 8, the deformed shape of the third coupling portion 13*c* when the terminal portion 11 and the conductor connection portion 12 are brought close to each other is indicated by a solid line, and the shape before the deformation is indicated by a two-dot chain line.

At least a third coupling portion 13*c* side of the first coupling portion 13*a* and a third coupling portion 13*c* side of the second coupling portion 13*b* are formed in a flat plate-shaped piece shape in the connecting portion 13 described here (FIGS. 5 to 7). Further, the third coupling portion 13*c* described here is formed by bending a rectangular flat plate-shaped portion into a crank shape (FIGS. 5 to 7).

The connector 1 of the present embodiment is configured to include one or more terminal fittings 10. The connector 1 described here includes the plurality of terminal fittings 10.

The housing 20 is formed of an insulating material such as a synthetic resin. The housing 20 includes an inner accommodating chamber 20*a* that accommodates the terminal fitting 10 from the terminal portion 11 to the connecting portion 13, and an opening (hereinafter, referred to as a "terminal drawing port") 20*b* that allows the conductor connection portion 12 of the terminal fitting 10 to be drawn out of the accommodating chamber 20*a* in the removal direction (FIGS. 3 and 5). The housing 20 has a smooth terminal drawing region 20*c* provided with the terminal drawing port 20*b* (FIG. 3).

The terminal fitting 10 is inserted into the accommodating chamber 20*a* from the terminal drawing port 20*b*. The terminal fitting 10 is inserted into the accommodating chamber 20*a* from the terminal portion 11. In the housing 20, the conductor connection portion 12 protrudes from the terminal drawing port 20*b* in the removal direction in a state in which the accommodating chamber 20*a* accommodates from the terminal portion 11 to the connecting portion 13.

The accommodating chamber 20*a* includes a first accommodating portion 20*d* that accommodates the terminal portion 11 and the first coupling portion 13*a*, and a second accommodating portion 20*e* that accommodates the second coupling portion 13*b* (FIG. 5). The first accommodating portion 20*d* is formed such that the tubular axis direction of the accommodated terminal portion 11 faces the insertion-and-removal direction with respect to the counterpart terminal portion. In addition, the second accommodating portion 20*e* in the accommodating chamber 20*a* described here accommodates the third coupling portion 13*c*.

When the terminal fitting 10 is inserted into the accommodating chamber 20*a* from the terminal portion 11 to the third coupling portion 13*c* of the connecting portion 13, an end portion of the third coupling portion 13*c* on a second coupling portion 13*b* side abuts on a peripheral edge of the terminal drawing port 20*b*. In the terminal fitting 10, the end portion is further pushed into the accommodating chamber 20*a* in the abutting state, such that the end portion of the third coupling portion 13*c* on the second coupling portion 13*b* side is pushed up by receiving a force from the peripheral edge of the terminal drawing port 20*b*, and with pushing up of the end portion, the terminal portion 11 is pressed against an inner wall portion of the accommodating chamber 20*a*. Therefore, the third coupling portion 13*c* starts to be elastically deformed. Then, in the terminal fitting 10, the end portion is further pushed into the accommodating chamber 20*a*, the third coupling portion 13*c* continues to be elastically deformed by the force of the end portion received from the peripheral edge of the terminal drawing port 20*b* while sliding the terminal portion 11 on the inner wall portion of the accommodating chamber 20*a* and sliding the end portion of the third coupling portion 13*c* on the second coupling portion 13*b* side on the peripheral edge of the terminal drawing port 20*b*, and the second coupling portion 13*b* thus reaches the peripheral edge of the terminal drawing port 20*b*. In the terminal fitting 10, the end portion is further pushed into the accommodating chamber 20*a*, the third coupling portion 13*c* continues to be elastically deformed by the force of the second coupling portion 13*b* received from the peripheral edge of the terminal drawing port 20*b* until the tubular axis direction of the terminal portion 11 and the tubular axis direction of the conductor connection portion 12 face the same direction, while sliding the terminal portion 11 on the inner wall portion of the accommodating chamber 20*a* and sliding the second coupling portion 13*b* on the peripheral edge of the terminal drawing port 20*b*. Thereafter, the terminal fitting 10 is pushed into a predetermined position (accommodation completion position) of the accommodating chamber 20*a* while sliding the terminal portion 11 on the inner wall portion of the accommodating chamber 20*a* and sliding the second coupling portion 13*b* on the inner wall portion of the accommodating chamber 20*a*.

As such, the elastic deformation of the third coupling portion 13*c* in the accommodating chamber 20*a* allows the second coupling portion 13*b* to be displaced from an extending direction in a direction intersecting with the removal direction to an extending direction in the removal direction (FIGS. 5 and 7). Since in the terminal fitting 10, the third coupling portion 13*c* is elastically deformed in the accommodating chamber 20*a*, each of the terminal portion 11 and the second coupling portion 13*b* is pressed against the inner wall portion of the accommodating chamber 20*a*. Therefore, the connecting portion 13 in the accommodating chamber 20*a* allows the conductor connection portion 12 to extend in the removal direction in a state in which a first resilient force F1 due to the elastic deformation of the third coupling portion 13*c* is applied from the terminal portion 11 to a first inner wall portion $\mathbf{20}d_1$ of the accommodating chamber 20*a* and in a state in which a second resilient force F2 opposite to the first resilient force F1 due to the elastic deformation of the third coupling portion 13*c* is applied from the second coupling portion 13*b* to a second inner wall portion $\mathbf{20}e_1$ of the accommodating chamber 20*a* (FIG. 5). Accordingly, the conductor connection portion 12 can be positioned between the terminal fitting 10 and the housing 20 with respect to the accommodating chamber 20*a*.

The first inner wall portion $\mathbf{20}d_1$ is an inner wall portion of the first accommodating portion 20*d*. The first accommodating portion 20*d* has a third inner wall portion $\mathbf{20}d_2$ arranged to face the first inner wall portion $\mathbf{20}d_1$ opposite to an applying direction of the first resilient force F1 (FIG. 5). On the other hand, the second accommodating portion 20*e* has the second inner wall portion $\mathbf{20}e_1$ offset in an applying direction of the second resilient force F2 from the third inner wall portion $\mathbf{20}d_2$ (FIG. 5). Offset amounts of the second inner wall portion $\mathbf{20}e_1$ and the third inner wall portion $\mathbf{20}d_2$ are set to be equivalent to those of the first coupling portion 13*a* and the second coupling portion 13*b* by the crank-shaped third coupling portion 13*c*. Therefore, the terminal fitting 10 is accommodated in the accommodating chamber 20*a* in a state in which the tubular axis direction of the terminal portion 11 and the tubular axis direction of the conductor connection portion 12 face the same direction and the insertion-and-removal direction.

Further, the second accommodating portion 20*e* has a vertical wall portion $\mathbf{20}e_2$ connecting the second inner wall portion $\mathbf{20}e_1$ to the third inner wall portion $\mathbf{20}d_2$ (FIG. 5). The third coupling portion 13*c* is accommodated in the second accommodating portion 20*e* with a space from the vertical wall portion $\mathbf{20}e_2$.

Figure 9:
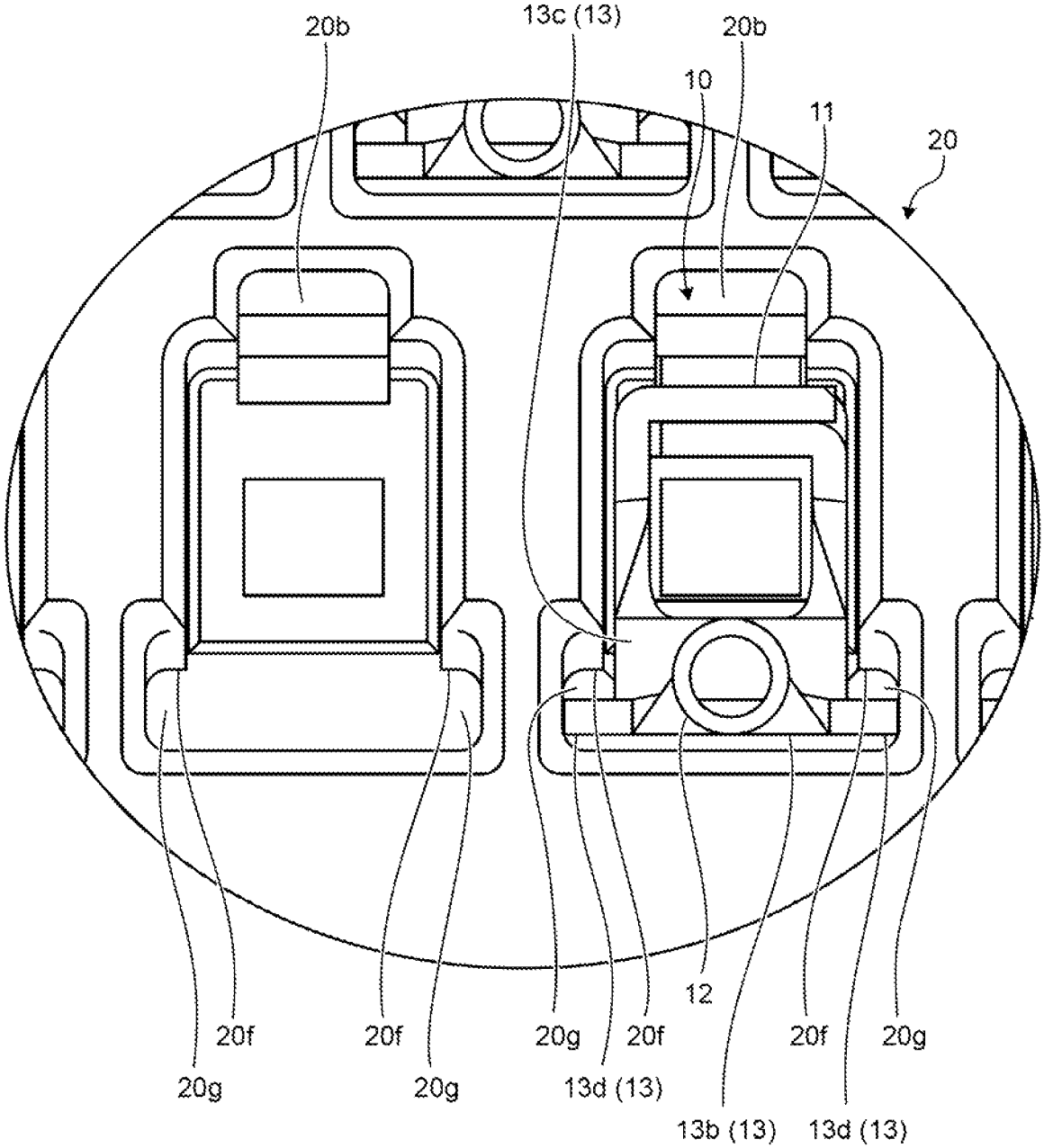
FIG. 9 is a plan view of the housing when partially viewed from a terminal drawing port side, and illustrates a relationship between a projection portion of the terminal fitting and a projection locking portion of the housing.

The connecting portion 13 described here has projection portions 13*d* protruding from the second coupling portion 13*b* (FIGS. 6 and 7). The accommodating chamber 20*a* described here includes a projection locking portion 20*f* that locks the projection portion 13*d* opposite to the applying direction of the second resilient force F2 from the second coupling portion 13*b* to the second inner wall portion $\mathbf{20}e_1$ while allowing the conductor connection portion 12 to extend in the removal direction (FIG. 9). As a result, in the terminal fitting 10, a deflection of the conductor connection portion 12 toward the applying direction of the second resilient force F2 is suppressed by the second inner wall portion $\mathbf{20}e_1$ that locks the second coupling portion 13*b*, and the deflection of the conductor connection portion 12 in a direction opposite to the applying direction of the second resilient force F2 is suppressed by the projection locking portion 20*f* that locks the projection portion 13*d*.

Figure 10:
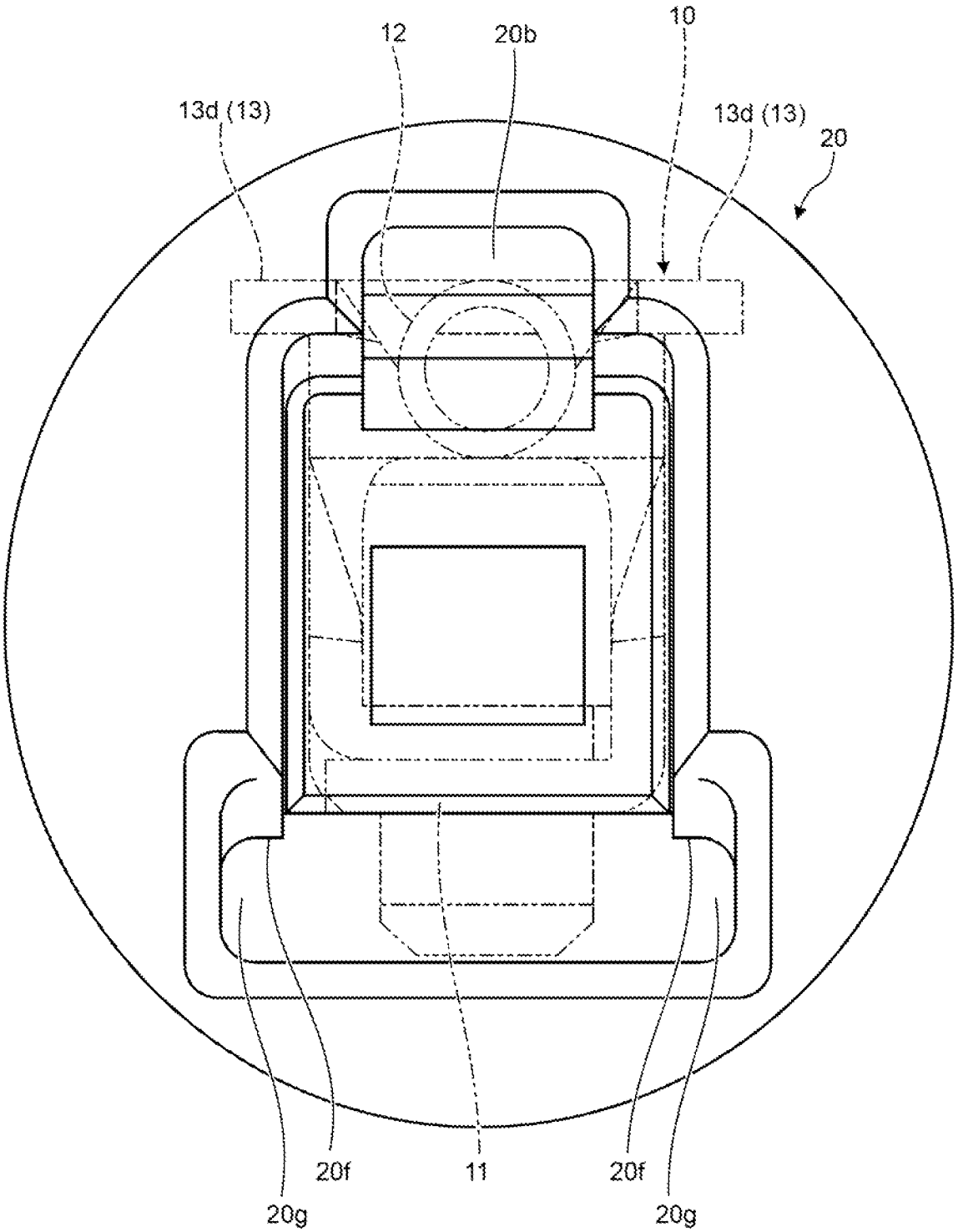
FIG. 10 is a plan view of the housing when partially viewed from the terminal drawing port side, and describes suppression of erroneous insertion of the terminal fitting.

The projection portion 13*d* described here is a piece protruding on the same plane from the third coupling portion 13*c* side (flat plate-shaped piece part) of the second coupling portion 13*b*. Furthermore, the projection portions 13*d* described here protrude one by one toward one side and the other side in the insertion-and-removal direction and a direction orthogonal to the applying direction of the second resilient force F2. In addition, the projection portion 13*d* is inserted into the accommodating chamber 20*a* described here together with the insertion of the terminal fitting 10 into the accommodating chamber 20*a*, and a groove 20*g* for guiding the projection portion 13*d* while being inserted is formed in each projection portion 13*d* (FIG. 9). As the projection locking portion 20*f* described here, a wall surface of the groove 20*g* is used. Therefore, in the connector 1, when the terminal fitting 10 is inserted into the accommodating chamber 20*a* in a correct posture, the groove 20*g* serves as a guide groove of the projection portion 13*d* to assist the insertion of the terminal fitting 10. Furthermore, the accommodating chamber 20*a* described here is formed such that even when the terminal fitting 10 is inserted after being rotated, for example, by 90 degrees or 180 degrees about the tubular axis of the terminal portion 11, the projection portions 13*d* collide with the wall surface of the housing 20 in the middle of the insertion (FIG. 10). As a result, it is possible to avoid erroneous insertion when the terminal fitting 10 is inserted into the accommodating chamber 20*a* in the connector 1.

The housing 20 described here is provided with a plurality of accommodating chambers 20*a*, and each accommodating chamber 20*a* accommodates the terminal fitting 10. All the accommodating chambers 20*a* are formed so as to accommodate each of the terminal fittings 10 from the terminal portion 11 to the connecting portion 13 in the same direction and arrange each of the terminal drawing ports 20*b* on the same plane. All the accommodating chambers 20*a* are arranged in a lattice pattern in the housing 20. Thus, the housing 20 described here has a rectangular and smooth terminal drawing region 20*c* provided with a plurality of terminal drawing ports 20*b*.

In the connector 1, it is not necessary to accommodate the terminal fitting 10 in all the accommodating chambers 20*a*, and it is sufficient that the terminal fitting 10 is accommodated in the accommodating chamber 20*a* in a place required on an electric circuit.

The housing 20 described here has a housing body 21 in which all the accommodating chambers 20*a* are formed (FIGS. 1 to 5). The housing body 21 in this example is formed in a rectangular parallelepiped shape and has first to sixth outer wall surfaces 21*a* to 21*f* (FIGS. 1 to 3).

All the terminal drawing ports 20*b* are arranged on a first outer wall surface 21*a*. Therefore, the terminal drawing region 20*c* is provided on the first outer wall surface 21*a* (FIG. 3).

In the housing body 21, the third outer wall surface 21*c* and the fourth outer wall surface 21*d* are arranged in parallel and connected to each other in orthogonal to the first outer wall surface 21*a*. In the housing 20, the conductor connection portions 12 of all the terminal fittings 10 protruding from the terminal drawing ports 20*b* are covered from a third outer wall surface 21*c* side and a fourth outer wall surface 21*d* side to protect the conductor connection portions 12. Therefore, the housing 20 includes a first protective body 22 connected to the third outer wall surface 21*c* while being arranged to face the third outer wall surface 21*c* with a space therebetween and protruding from the first outer wall surface 21*a*, and a second protective body 23 connected to the fourth outer wall surface 21*d* while being arranged to face the fourth outer wall surface 21*d* with a space therebetween and protruding from the first outer wall surface 21*a* (FIGS. 1 to 3).

The first protective body 22 and the second protective body 23 are arranged in a part of the housing body 21 excluding a fitting connection portion 21*g* (FIGS. 1 to 3). The fitting connection portion 21*g* is a portion that enables fitting connection along a connector insertion direction into a counterpart fitting connection portion (not illustrated) of a counterpart housing and removal along a connector removal direction from the inside of the counterpart fitting connection portion, and the terminal fitting 10 is accommodated in the fitting connection portion 21*g*. The fitting connection portion 21*g* is provided on a second outer wall surface 21*b* side of the housing body 21. Therefore, the first protective body 22 and the second protective body 23 are arranged on the first outer wall surface 21*a* side of the housing body 21. Further, in the housing 20, the first protective body 22 is arranged on one lateral side end portion, and the second protective body 23 is arranged on the other lateral side end portion. Therefore, in the following description, the first protective body 22 will be referred to as a "first housing side wall 22" and the second protective body 23 will be referred to as a "second housing side wall 23", if necessary.

The first protective body 22 in this example has a rectangular flat plate-shaped flat plate portion 22*a* arranged to face the third outer wall surface 21*c* in parallel with a space therebetween (FIGS. 1 to 3). In the first protective body 22, the flat plate portion 22*a* has a protrusion portion $\mathbf{22}a_1$ protruding from the first outer wall surface 21*a*, and the protrusion portion $\mathbf{22}a_1$ covers the conductor connection portions 12 of all the terminal fittings 10 from the third outer wall surface 21*c* side. In addition, the second protective body 23 in this example has a rectangular flat plate-shaped flat plate portion 23*a* arranged to face the fourth outer wall surface 21*d* in parallel with a space therebetween (FIGS. 1 to 3). In the second protective body 23, the flat plate portion 23*a* has a protrusion portion $\mathbf{23}a_1$ protruding from the first outer wall surface 21*a*, and the protrusion portion $\mathbf{23}a_1$ covers the conductor connection portions 12 of all the terminal fittings 10 from the fourth outer wall surface 21*d* side.

Moreover, in the housing body 21, the fifth outer wall surface 21*e* and the sixth outer wall surface 21*f* are arranged in parallel and connected to each other in orthogonal to the first outer wall surface 21*a*, the third outer wall surface 21*c*, and the fourth outer wall surface 21*d*. In the connector 1 described here, the conductive component 40 is drawn out to the sixth outer wall surface 21*f* side, which will be described later.

In the connector 1, the conductive component 40 is connected to the terminal fitting 10 accommodated in the accommodating chamber 20*a* before the cover 30 is assembled to the housing 20.

The conductive component 40 is formed as a laminate of a conductor and an insulator with through-holes 41 (FIGS. 3 to 5). The conductor is soldered to the conductor connection portion 12 inserted into the through-hole 41 and physically and electrically connects the conductor and the conductive components 40. The conductive component 40 includes a plurality of conductors, and a circuit portion is formed by each conductor.

The conductive component 40 is, for example, a component formed in a sheet shape by a conductor and an insulator having flexibility, and has a flat laminate having flexibility due to the conductor and the insulator. As the type of conductive component 40, a flexible printed circuit board (so-called FPC), a printed circuit such as a membrane wiring board, a flat cable (so-called FC), a flexible flat cable (so-called FFC), and the like can be considered. As the conductive component 40, a printed circuit board (so-called PCB) harder than these may be used. The conductive component 40 described here is a flexible printed circuit board (so-called FPC), and is formed in a rectangular shape.

The conductive component 40 includes a conductor connection region 40*a* that physically and electrically connects the conductor to the conductor connection portion 12 of the terminal fitting 10 protruding from the terminal drawing port 20*b*, and a conductor drawing region 40*b* that is drawn out in a drawing direction from the conductor connection region 40*a* so as to protrude from the housing 20 (FIGS. 2 to 4). In the conductive component 40, the conductor connection region 40*a* is accommodated in an inner space formed by the housing 20 and the cover 30 in the assembled state, and the conductor drawing region 40*b* is drawn out from a drawing port formed by the housing 20 and the cover 30 in the assembled state. The conductive component 40 described here is divided into the rectangular conductor connection region 40*a* and the rectangular conductor drawing region

40*b*. In the following, when simply described as the "drawing direction" without being particularly specified, it indicates the drawing direction of the conductor drawing region 40*b* in the conductive component 40.

The conductor connection region 40*a* has the through-holes 41 which are through-holes through which the conductor connection portions 12 are inserted and in which electrical connection portions of the conductors on inner peripheral surfaces of the through-holes are electrically connected to the conductor connection portions 12 (FIGS. 3 to 5). Since the conductor connection portions 12 of all the terminal fittings 10 are electrically connected to the conductor connection region 40*a* described here, a circular through-hole 41 is formed in each terminal fitting 10.

Here, a strength of the conductor connection region 40*a* is supplemented by a reinforcing plate 50. Thus, the reinforcing plate 50 is integrated with the conductor connection region 40*a* in a laminated state (FIGS. 3 to 5). The reinforcing plate 50 is formed in a flat plate shape using an insulating material such as a synthetic resin. The reinforcing plate 50 described here is formed as a flat plate having the same outline shape (that is, a rectangle having the same shape as the conductor connection region 40*a*) as the conductor connection region 40*a*. The reinforcing plate 50 has a first plane to be brought into contact with the conductor connection region 40*a*, and is integrated with the conductor connection region 40*a* in the laminated state by bonding the first plane to the conductor connection region 40*a* with an adhesive or the like.

The reinforcing plate 50 is sandwiched between the conductor connection region 40*a* and the terminal drawing region 20*c* by bringing the first plane into contact with the conductor connection region 40*a* and bringing a second plane into contact with the terminal drawing region 20*c*. Thus, in the reinforcing plate 50, a through-hole (hereinafter, referred to as a "terminal insertion hole") 50*a* concentric with the through-hole 41 is formed in each of the through-holes 41 (FIGS. 3 to 5). The terminal insertion hole 50*a* described here is formed in the same shape as the through-hole 41.

In the connector 1, the conductor connection portion 12 of the terminal fitting 10 accommodated in the accommodating chamber 20*a* of the housing 20 is inserted into the through-hole 41 of the conductive component 40 and the terminal insertion hole 50*a* of the reinforcing plate 50, while assembling the conductive component 40 to the housing 20. Therefore, in the connector 1, in order to clarify an assembling position of the conductive component 40 to the housing 20, the conductor connection portion 12 is inserted into the through-hole 41 of the conductive component 40 and the terminal insertion hole 50*a* of the reinforcing plate 50, while allowing positioning projections 24 provided in the housing 20 to be inserted into the through-holes 42 and 50*b* provided in the conductive component 40 and the reinforcing plate 50, respectively (FIGS. 2 to 4).

The positioning projection 24 is a projection portion protruding from the housing body 21, and protrudes greater than the conductor connection portion 12 toward a direction drawn out from the terminal drawing port 20*b* of the conductor connection portion 12. The positioning projections 24 described here are formed in a columnar shape, and are provided one by one with the terminal drawing region 20*c* interposed therebetween. In addition, the through-holes 42 and 50*b* described here are formed in a circular shape.

Soldering is performed for each combination of the conductor connection portion 12 and the through-hole 41 as a pair, and the conductor connection portion 12 and the through-hole 41 are fixed in a state in which the terminal fitting 10, the housing 20, the conductive component 40, and the reinforcing plate 50 are installed in the connector 1. Thereafter, the cover 30 is assembled in the connector 1.

The cover 30 is formed of an insulating material such as a synthetic resin. The cover 30 covers the housing 20 from the outside by being assembled to the housing 20. Specifically, the cover 30 is formed to cover the protrusion part of the housing 20 from the counterpart fitting connection portion from the outside when the fitting connection portion 21*g* and the counterpart fitting connection portion are fitted and connected. In other words, the cover 30 is formed to cover the remaining part of the housing 20 from the outside in a state in which the fitting connection portion 21*g* protrudes from a space inside the cover. Thus, the cover 30 covers the terminal drawing region 20*c* (that is, the conductor connection portions 12 of all the terminal fittings 10 protruding from the terminal drawing ports 20*b*).

The cover 30 has a cover main wall 31 that forms a main body to cover a front protrusion part (a part protruding from the counterpart fitting connection portion in the housing 20 when the fitting connection portion 21*g* and the counterpart fitting connection portion are fitted and connected) (FIGS. 1 and 2). The cover main wall 31 described here has a first wall body 31A and a second wall body 31B connected in an intersecting state (FIG. 2). In the cover 30, the first wall body 31A is arranged to face the first outer wall surface 21*a* with a space therebetween, and the second wall body 31B is arranged to face a first outer wall surface 21*a* side of the fifth outer wall surface 21*e* with a space therebetween.

Furthermore, the cover 30 has a first cover side wall 32 and a second cover side wall 33 which are arranged to face each other with a space therebetween, are connected to both end portions of the cover main wall 31 in an orthogonal state, and have flexibility (FIGS. 1 and 2). The first cover side wall 32 and the second cover side wall 33 are arranged to face each other with a space therebetween in a direction (hereinafter, referred to as a "width direction") orthogonal to the connector insertion direction (or the connector removal direction) and the drawing direction of the conductive component 40. The first cover side wall 32 and the second cover side wall 33 are connected to both end portions of the cover main wall 31 in the width direction (both end portions of each of the first wall body 31A and the second wall body 31B) in an orthogonal state.

When the assembly between the cover 30 and the housing 20 is completed, the flat plate-shaped first cover side wall 32 is arranged to face the flat plate portion 22*a* of the first housing side wall 22 in parallel from the outside, and the flat plate-shaped second cover side wall 33 is arranged to face the flat plate portion 23*a* of the second housing side wall 23 in parallel from the outside. The first cover side wall 32 is formed to be bent and deformed at least in a direction away from the first housing side wall 22. In addition, the second cover side wall 33 is formed to be bent and deformed at least in a direction away from the second housing side wall 23.

Moreover, the cover 30 includes a first opening 30*a* that has end portions on each of the cover main wall 31, the first cover side wall 32, and the second cover side wall 33 on the connector insertion direction side as peripheral edge portions (FIGS. 1 and 2), and a second opening 30*b* that has end portions of each of the cover main wall 31, the first cover side wall 32, and the second cover side wall 33 in the drawing direction of the conductive component 40 (that is, a direction in which the first cover side wall 32 and the second cover side wall 33 are arranged to face each other (width direction) and a direction orthogonal to the connector insertion direction (or connector removal direction)) as peripheral edge portions, and has a part being used as a drawing port of the conductive component 40 (FIG. 2). The first opening 30*a* described here is arranged to face the first wall body 31A with a space therebetween on the connector insertion direction side, and is formed as an opening having side portions of each of the second wall body 31B, the first cover side wall 32, and the second cover side wall 33 as peripheral edge portions. In addition, the second opening 30*b* described here is arranged to face the second wall body 31B with a space therebetween, and is formed as an opening having side portions of each of the first wall body 31A, the first cover side wall 32, and the second cover side wall 33 as peripheral edge portions. In the cover 30, the first opening 30*a* and the second opening 30*b* are connected in an orthogonal state. Thus, the first cover side wall 32 and the second cover side wall 33 each have the largest amount of bending deformation at an intersection portion in which the first opening 30*a* side and the second opening 30*b* side intersect.

In the connector 1, a space is formed between the first outer wall surface 21*a* of the housing body 21, the protrusion portion $\mathbf{22}a_1$ of the first protective body 22, and the protrusion portion $\mathbf{23}a_1$ of the second protective body 23 and the first wall body 31A and the second wall body 31B of the cover 30, and the conductor connection portions 12 of all the terminal fittings 10 are arranged in the space. In addition, the space communicates with the outside through a part of the second opening 30*b* in the connector 1. The part of the second opening 30*b* is a gap formed between the housing 20 and the first wall body 31A. Therefore, the gap in the connector 1 serves as a drawing port through which the conductive component 40 is drawn out from the sixth outer wall surface 21*f* side to the outside.

The cover 30 is inserted into and connected to the housing 20 from the first outer wall surface 21*a* side along a connector fitting direction. A guide structure 60 is provided between the housing 20 and the cover 30 to guide each other to the assembly completion position along the connection direction (FIG. 1). The guide structure 60 includes a guide projection 61 that is a protrusion provided in one of the housing 20 and the cover 30, having a wedge-shaped cross section orthogonal to the connection direction, and extending in the connection direction, and a guide groove 62 that is a groove provided in the other of the housing 20 and the cover 30 and extending in the connection direction such that the guide groove 62 and the inserted guide projection 61 guide each other along the connection direction. Each of the guide projection 61 and the guide groove 62 has at least two planes parallel to or intersecting with each other along the connection direction of the housing 20 and the cover 30.

Two guide structures 60 are provided in the connector 1 described here. The two guide structures 60 are provided such that a protruding direction of one guide projection 61 and a protruding direction of the other guide projection 61 are opposite to each other. The guide projections 61 described here are provided on the first cover side wall 32 and the second cover side wall 33 of the cover 30. Here, the guide projection 61 is formed on side portion of each of the rectangular flat plate-shaped first cover side wall 32 and the rectangular flat plate-shaped second cover side wall 33 on the second opening 30*b* side. In the cover 30, each of the guide projections 61 protrudes inwardly and is arranged to face each other. Further, the guide grooves 62 described here are provided in the first housing side wall 22 and the second housing side wall 23 of the housing 20, respectively. The guide groove 62 of the first housing side wall 22 is arranged adjacent to the flat plate portion 22*a* in the sixth outer wall surface 21*f* side. The guide groove 62 of the second housing side wall 23 is arranged adjacent to the flat plate portion 23*a* in the sixth outer wall surface 21*f* side.

As described above, in the connector 1, the fitting connection portion 21*g* of the housing body 21 is fitted into and connected to the counterpart fitting connection portion of the counterpart housing. Here, the counterpart fitting connection portion is formed in a square tubular shape, and the fitting connection portion 21*g* is inserted and fitted into the counterpart fitting connection portion. A holding structure 70 is provided between the housing 20 and the counterpart housing to hold the fitted and connected state of the fitting connection portion 21*g* (FIGS. 1 to 3). The housing 20 includes a locking body 71 and a locking release arm 72 as components of the holding structure 70, the locking body 71 being locked to a counterpart locking body (not illustrated) of the counterpart fitting connection portion in a direction opposite to the fitting connection direction when the fitting connection portion 21*g* and the counterpart fitting connection portion are fitted and connected to hold the state in which the fitting connection portion 21*g* and the counterpart fitting connection portion are fitted and connected, and the locking release arm 72 being bent in accordance with a locking release force applied to a force point portion 72*a* and releasing a lockable state between the locking body 71 and the counterpart locking body.

The locking body 71 and the locking release arm 72 are arranged on a side opposite to the second opening 30*b* side in the housing 20 (that is, the fifth outer wall surface 21*e* side of the housing 20) when the housing 20 and the cover 30 are assembled. The locking release arm 72 is formed to push toward the second opening 30*b* side (that is, toward the fifth outer wall surface 21*e*) when releasing the lockable state between the locking body 71 and the counterpart locking body. The locking release arm 72 includes the force point portion 72*a* as a place where an operator performs the pushing operation.

Here, the locking body 71 is formed as a locking projection, and the counterpart locking body is formed as a through-hole into which the locking body 71 is inserted and then locked. The locking body 71 described here is locked on a peripheral wall of the counterpart locking body as the through-hole. Further, the locking release arm 72 described here has a cantilever shape that can be elastically deformed with a fixed end as a fulcrum. Here, the fixed end is provided on the fitting connection portion 21*g* side of the fifth outer wall surface 21*e*, and a free end is provided on the first outer wall surface 21*a* side (part excluding the fitting connection portion 21*g*) of the fifth outer wall surface 21*e*. The free end of the locking release arm 72 serves as the force point portion 72*a*. Here, the force point portion 72*a* is formed in a rectangular flat plate shape. In addition, the locking release arm 72 has a wall surface arranged to face the fitting connection portion 21*g* side of the fifth outer wall surface 21*e* of the housing body 21 with a space therebetween. The locking body 71 is provided on a wall surface opposite to the wall surface and between the fixed end and the free end of the locking release arm 72 in a protruding state. When the locking release arm 72 formed as such releases the lockable state between the locking body 71 and the counterpart locking body, the locking release force directed to the fifth outer wall surface 21*e* is applied to the force point portion 72*a*. In the holding structure 70, the locking release arm 72 is bent by the locking release force, and the locking body 71 is displaced to the fifth outer wall surface 21*e* side in conjunction with the bending of the locking release arm 72, and the lockable state between the locking body 71 and the counterpart locking body is thus released.

Since the cover 30 has the second wall body 31B arranged to face the first outer wall surface 21*a* side of the fifth outer wall surface 21*e* with a space therebetween as described above, the second wall body 31B covers not only the first outer wall surface 21*a* side of the fifth outer wall surface 21*e* but also the free end (that is, the force point portion 72*a*) of the locking release arm 72. Therefore, the second wall body 31B is provided with a pushing portion 34 that covers the force point portion 72*a* and pushes and moves the force point portion 72*a* toward the fifth outer wall surface 21*e* side by displacing itself to the second opening 30*b* side (the fifth outer wall surface 21*e* side) (FIGS. 1 and 2). The pushing portion 34 is formed in a cantilever shape having flexibility. The pushing portion 34 described here is formed in a piece shape with the first wall body 31A side as a fixed end and the first opening 30*a* side as a free end. As the pushing portion 34 is pushed and moved toward the fifth outer wall surface 21*e* side, the force point portion 72*a*, which is in a contact state, is pushed and moved toward the fifth outer wall surface 21*e* side to release the lockable state between the locking body 71 and the counterpart locking body.

As described above, in the connector 1 of the present embodiment, the connecting portion 13 in the accommodating chamber 20*a* allows the conductor connection portion 12 to extend in the removal direction in a state in which a first resilient force F1 due to the elastic deformation of the third coupling portion 13*c* is applied from the terminal portion 11 to the first inner wall portion $\mathbf{20}d_1$ of the accommodating chamber 20*a* and in a state in which a second resilient force F2 in a direction opposite to the first resilient force F1 due to the elastic deformation of the third coupling portion 13*c* is applied from the second coupling portion 13*b* to the second inner wall portion $\mathbf{20}e_1$ of the accommodating chamber 20*a*. That is, in the connector 1, the terminal fitting 10 is positioned in the accommodating chamber 20*a* in a state in which the conductor connection portion 12 extends in the removal direction and is drawn out from the terminal drawing port 20*b* by allowing the terminal fitting 10 to apply the resilient forces in opposite directions from the terminal portion 11 and the second coupling portion 13*b* to the inner wall portion of the accommodating chamber 20*a*. Therefore, in the connector 1, positioning between the conductor connection portion 12 and the through-hole 41 of the conductive component 40 is also performed, and insertion of the conductor connection portion 12 into the through-hole 41 is facilitated. For example, in the connector 1 described here, since the conductor connection portion 12 is inserted into the through-hole 41 when the conductive component 40 is assembled to the housing 20 (that is, when the positioning projection 24 of the housing 20 is inserted into the through-hole 42 of the conductive component 40), when performing the assembly, insertion of the conductor connection portion 12 into the through-hole 41 is facilitated. As such, in the connector 1, since it is not necessary to assemble the terminal holding member such as a retainer for positioning and holding the terminal fitting in the accommodating chamber as in the conventional case, to the housing, it is possible to perform simple positioning between the conductor connection portion 12 and the through-hole 41, and accordingly, it is facilitated to assemble the conductive component 40 to the terminal fitting 10 and the housing 20. Particularly, the effect of the connector 1 is remarkable because the conductor connection portions 12 of the plurality of terminal fittings 10 are inserted into the through-holes 41 of one conductive component 40 almost simultaneously.

Furthermore, in the connector 1 of the present embodiment, the counterpart terminal portion of the counterpart terminal fitting is fitted into and connected to the terminal portion 11 of the terminal fitting 10 when being fitted into and connected to the counterpart connector, and at that time, the terminal portion 11 receives a force in the removal direction from the counterpart terminal portion. In the connector 1, since the third coupling portion 13*c* can be elastically deformed in a direction in which the terminal portion 11 receives the force from the counterpart terminal portion (FIG. 8), the force received by the terminal portion 11 can be absorbed by the third coupling portion 13*c*. Therefore, in the connector 1, a load applied between the terminal portion 11 and the counterpart terminal portion when they are fitted and connected can be reduced, and thus durability of the terminal fitting 10 and the counterpart terminal fitting can be improved.

Furthermore, in the connector 1 of the present embodiment, a deflection of the conductor connection portion 12 toward the applying direction of the second resilient force F2 is suppressed by the second inner wall portion $\mathbf{20}e_1$ that locks the second coupling portion 13*b*, and the deflection of the conductor connection portion 12 in a direction opposite to the applying direction of the second resilient force F2 is suppressed by the projection locking portion 20*f* that locks the projection portion 13*d*. Therefore, in the connector 1, a load on a solder portion 15 (FIG. 2) formed between the conductor connection portion 12 of the terminal fitting 10 and the conductor of the conductive component 40 can be suppressed low, and durability of the solder portion 15 can be improved. Therefore, a conduction performance between the conductor connection portion 12 and the conductor of the conductive component 40 can be maintained for a long period of time.

In the connector according to the present embodiment, the terminal fitting is positioned in the accommodating chamber in a state in which the conductor connection portion extends in the removal direction and is drawn out from the terminal drawing port by allowing the terminal fitting to apply resilient forces in opposite directions from the terminal portion and the second coupling portion to the inner wall portion of the accommodating chamber. Therefore, in the connector, positioning between the conductor connection portion and the through-hole of the conductive component is also performed, and insertion of the conductor connection portion into the through-hole is facilitated. As such, in the connector according to the present embodiment, since it is not necessary to assemble the terminal holding member such as a retainer for positioning and holding the terminal fitting in the accommodating chamber as in the conventional case, to the housing, it is possible to perform simply positioning between the conductor connection portion and the through-hole, and accordingly, it is facilitated to assemble the conductive component to the terminal fitting and the housing.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal fitting including a terminal portion that is fitted into and connected to a counterpart terminal portion, a conductor connection portion, and a connecting portion that connects the terminal portion and the conductor connection portion;

a housing including an accommodating chamber that accommodates the terminal fitting from the terminal portion to the connecting portion, and a terminal drawing port that allows the conductor connection portion to be drawn out of the accommodating chamber toward a removal direction of the terminal portion with respect to the counterpart terminal portion; and a conductive component formed as a laminate of a conductor and an insulator with a through-hole, and soldering the conductor to the conductor connection portion inserted into the through-hole and physically and electrically connecting the conductor connection portion and the conductor, wherein the connecting portion includes a first coupling portion that is coupled to the terminal portion, a second coupling portion that is coupled to the conductor connection portion, and a third coupling portion that is elastically deformable and connecting the first coupling portion and the second coupling portion, the connecting portion in the accommodating chamber allows the conductor connection portion to extend in the removal direction in a state in which a first resilient force due to elastic deformation of the third coupling portion is applied from the terminal portion to a first inner wall portion of the accommodating chamber and in a state in which a second resilient force opposite to the first resilient force due to the elastic deformation of the third coupling portion is applied from the second coupling portion to a second inner wall portion of the accommodating chamber, and the first coupling portion, the second coupling portion and the third coupling portion are accommodated in the accommodating chamber.

2. The connector according to claim 1, wherein the elastic deformation of the third coupling portion in the accommodating chamber allows the second coupling portion to be displaced from an extending direction in a direction intersecting with the removal direction to an extending direction in the removal direction.

3. The connector according to claim 1, wherein the third coupling portion is formed in a crank shape in which the first coupling portion and the second coupling portion are offset in a direction orthogonal to the removal direction.

4. The connector according to claim 2, wherein the third coupling portion is formed in a crank shape in which the first coupling portion and the second coupling portion are offset in a direction orthogonal to the removal direction.

5. The connector according to claim 3, wherein the accommodating chamber includes a first accommodating portion that accommodates the terminal portion and the first coupling portion, and a second accommodating portion that accommodates the second coupling portion, the first accommodating portion includes a third inner wall portion arranged to face the first inner wall portion opposite to an applying direction of the first resilient force, and the second accommodating portion includes a second inner wall portion offset in an applying direction of the second resilient force from the third inner wall portion.

6. The connector according to claim 1, wherein the connecting portion includes a projection portion that protrudes from the second coupling portion, and the accommodating chamber includes a projection locking portion that locks the projection portion opposite to the applying direction of the second resilient force while allowing the conductor connection portion to extend in the removal direction.

7. The connector according to claim 2, wherein the connecting portion includes a projection portion that protrudes from the second coupling portion, and the accommodating chamber includes a projection locking portion that locks the projection portion opposite to the applying direction of the second resilient force while allowing the conductor connection portion to extend in the removal direction.

8. The connector according to claim 3, wherein the connecting portion includes a projection portion that protrudes from the second coupling portion, and the accommodating chamber includes a projection locking portion that locks the projection portion opposite to the applying direction of the second resilient force while allowing the conductor connection portion to extend in the removal direction.

9. The connector according to claim 5, wherein the connecting portion includes a projection portion that protrudes from the second coupling portion, and the accommodating chamber includes a projection locking portion that locks the projection portion opposite to the applying direction of the second resilient force while allowing the conductor connection portion to extend in the removal direction.

10. The connector according to claim 1, wherein an innermost end surface of the terminal portion contacts an inner end surface of the accommodating chamber.

* * * * *